US009708778B2

(12) United States Patent
Messina et al.

(10) Patent No.: US 9,708,778 B2
(45) Date of Patent: Jul. 18, 2017

(54) CONCRETE SLAB PANEL FORMING, REINFORCING, JOINT SEALING AND EDGE PROTECTING FRAMING SYSTEM

(71) Applicants: Gianfranco Messina, Maple (CA); Claudio Messina, Stouffville (CA)

(72) Inventors: Gianfranco Messina, Maple (CA); Claudio Messina, Stouffville (CA)

( * ) Notice: Subject to any disclaimer, the term of this patent is extended or adjusted under 35 U.S.C. 154(b) by 0 days.

(21) Appl. No.: 15/144,711

(22) Filed: May 2, 2016

(65) Prior Publication Data

US 2016/0319543 A1 Nov. 3, 2016

Related U.S. Application Data

(60) Provisional application No. 62/156,305, filed on May 3, 2015.

(51) Int. Cl.

| | |
|---|---|
| ***E01C 11/06*** | (2006.01) |
| ***E04C 5/08*** | (2006.01) |
| ***E04G 21/12*** | (2006.01) |
| ***E02D 31/08*** | (2006.01) |
| ***E02D 31/10*** | (2006.01) |
| ***E04B 1/49*** | (2006.01) |
| ***E04B 1/48*** | (2006.01) |
| ***E04B 5/28*** | (2006.01) |
| ***E04C 5/07*** | (2006.01) |

(Continued)

(52) U.S. Cl.

CPC ..... *E01C 11/06* (2013.01); *E01C 5/08* (2013.01); *E01C 9/001* (2013.01); *E02D 27/14* (2013.01); *E02D 31/08* (2013.01); *E02D 31/10* (2013.01); *E04B 1/483* (2013.01); *E04B 1/49* (2013.01); *E04B 5/28* (2013.01); *E04C 5/07* (2013.01); *E04C 5/08* (2013.01); *E04C 5/168* (2013.01); *E04C 5/18* (2013.01); *E04C 5/205* (2013.01); *E04C 5/206* (2013.01); *E04G 21/12* (2013.01)

(58) Field of Classification Search

CPC ..... E01C 11/06; E04C 5/205

See application file for complete search history.

(56) References Cited

U.S. PATENT DOCUMENTS 1,664,605 A * 4/1928 Fischer ..... E01C 23/023 404/87

1,769,990 A * 7/1930 Fischer ..... E01C 11/126 404/68

(Continued)

OTHER PUBLICATIONS cement.org; Placing Joints in Concrete Flatwork: Why, How, and When; Aug. 31, 2014, http://web.archive.org/web/20140831224838/http://www.cement.org/for-concrete-books-learning/concrete-technology/concrete-construction/contraction-control-joints-in-concrete-flatwork.*

*Primary Examiner* — Benjamin Schiffman

(74) *Attorney, Agent, or Firm* — Nasser Ashgriz; UIPatent Inc.

(57) ABSTRACT

A device for forming, reinforcing, joint sealing and edge protecting of a concrete slab panel, wherein the concrete slab panel having a volume, a length, a width, and a surface. The device comprising of an elongated post having a body, a top end and a bottom end with a plurality of elongated grooves extending along the body; a mounting frame has a length, a width and a thickness. The mounting frames having a connecting means to connect the mounting frame to the posts. The present invention eliminates the needs for saw-cut lines for crack inducement and acts as a joint sealer for the concrete slab to relieve the tensile stresses.

11 Claims, 15 Drawing Sheets

(51) Int. Cl.

| | |
|---|---|
| ***E04C 5/20*** | (2006.01) |
| ***E04C 5/16*** | (2006.01) |
| ***E04C 5/18*** | (2006.01) |
| ***E01C 5/08*** | (2006.01) |
| ***E01C 9/00*** | (2006.01) |
| ***E02D 27/14*** | (2006.01) |

(56) References Cited

U.S. PATENT DOCUMENTS 1,971,856 A * 8/1934 Higley ..... E01C 9/001 404/47
2,016,858 A * 10/1935 Hall ..... E01C 11/123 404/68
2,662,342 A * 12/1953 Peterson ..... A01G 1/08 172/15
2,949,828 A * 8/1960 Carnes ..... E01C 11/106 404/74
3,385,017 A * 5/1968 Williams ..... E01C 11/126 404/68
3,838,930 A * 10/1974 Koch ..... E01C 23/021 404/48
3,967,911 A * 7/1976 Miers ..... E01C 11/106 404/48
4,012,159 A * 3/1977 Berry ..... E01C 11/08 404/48
D251,070 S * 2/1979 Blake ..... D25/164
4,190,997 A * 3/1980 Holt ..... E04F 15/14 404/68
4,198,176 A * 4/1980 Bentz ..... E01C 11/126 249/9
4,516,875 A * 5/1985 Turner ..... E01C 11/08 249/3
4,875,801 A * 10/1989 Montrym ..... E01C 23/023 404/48
6,598,364 B1 * 7/2003 Pelles ..... E01C 11/126 404/47
8,464,464 B2 * 6/2013 Rosaen ..... A01G 1/08 47/33
2008/0056821 A1 * 3/2008 Shaw ..... E01C 11/06 404/87

* cited by examiner

CONCRETE SLAB PANEL FORMING, REINFORCING, JOINT SEALING AND EDGE PROTECTING FRAMING SYSTEM

RELATED APPLICATION

The present invention is a non-provisional patent application of a provisional patent application No. 62/156,305 filed May 3, 2015.

FIELD OF THE INVENTION

The present invention relates generally to slab construction and particularly to concrete slab flatwork on grade, as well as suspended or structural concrete slabs.

BACKGROUND OF THE INVENTION

Concrete slab is one of the main elements for the construction industry. During the curing process, concrete slab panels tend to curl up at joints and around its perimeter. Curled up slabs are unsafe and can cause the concrete panels to endure high levels of stress, which leads to cracks and maintenance issues down the road.

Differential shrinkage is the basic cause of curling. This occurs as the exposed top surface of the slab shrinks and the core of the slab does not. Concrete slabs, like many other construction materials, are not dimensionally stable when subjected to changes in the moisture content. The factors that affect the amount of curling in a concrete slab are the subbase material, concrete mix characteristics such as water/cement (w/c) ratio, cement type, aggregate type, admixture types, cement content and mix temperature.

Forming a series of saw-cut joints in a slab is one method to reduce stress due to shrinkage. Saw-cut joints are spaced according to guidelines from the cement association, and should have a depth of at least one-quarter of the slab thickness. By having a saw-cut in a concrete slab, the propagation of cracks in the slab is controlled and the weakened planes where the concrete can crack in a straight line forms. This produces an aesthetically pleasing appearance since the crack takes place below the finished concrete surface. The concrete has still cracked which is normal behaviour, but the absence of random cracks at the concrete surface gives the appearance of an un-cracked section.

Also for reducing curling in the concrete slab, the prior arts suggest to use different additives such as synthetic macro fibres, steel fibres to be added to ready-mix concrete. The cost of adding chemical additives to the concrete slab is high and it raises the construction cost. Another way to reduce curl is to reinforce the slab with large amounts of steel rebar which also increases the construction cost.

SUMMARY OF THE INVENTION

The present invention is a method and a device which is used for forming the concrete slabs in a construction industry. The present invention enables the manufacturer to pour a concrete slab in individual cells so there is no need for saw-cut contraction joints, formed construction joints, as well as adding joint filler to the joints. By the device and the method of the present invention, wide variety of shapes for the concrete cells and panels can be achieved. The most efficient way for the concrete cells and panels are in a honeycomb fashion so that each concrete slab panel has a hexagonal shape.

The present method of constructing, reinforcing, joint sealing and edge protecting of a continuous concrete slab over a prepared subgrade surface area, wherein the continuous concrete slab having a thickness, the method comprising the steps of determining a joint-spacing-length for said continuous concrete slab based on a predetermined factor of said thickness of the concrete slab; choosing a concrete-pattern-shape to prevent concrete curling after curing process; determining a polygon-side-length for said concrete-pattern-shape based on the joint-spacing-length; subdividing said prepared subgrade surface area into a plurality of said polygons using a plurality of mounting frames, wherein said mounting frames are connected and held on said prepared subgrade surface area by a plurality of mounting posts, wherein each said mounting frame having a frame-length, a frame-height, a frame-thickness, a frame-bottom end and a frame-top end; and pouring concrete onto the prepared subgrade surface area until the concrete reaches to said frame-top end; whereby the mounting frames assembly subdivide the continuous concrete slab into a plurality of said concrete-pattern-shapes by inducing formation of fine cracks along the frame-bottom end of said mounting frame and wherein said mounting frames act as saw-cuts and joint fillers between said concrete-pattern-shapes.

The present device for subdividing a continuous concrete slab into a plurality of a polygon concrete slabs over a prepared subgrade surface area to prevent curling, wherein the continuous concrete slab having a thickness, the device comprising a plurality of polygon shaped elements constructed by a plurality of mounting frames and mounting posts, wherein each said mounting frame forming a side of said polygon shaped element and each said mounting post forming a vertex of said polygon shaped element, each said mounting post having a body, a top, a bottom and a connecting means, wherein said post is perpendicularly placed over said prepared subgrade surface area; and each said mounting frame having a frame-length, a frame-height, a frame-thickness, a frame-bottom end and a frame-top end, said mounting frame connects to said post by a connecting means; whereby said mounting frames act as saw-cut lines to induce cracks and as joint sealers between said polygon shaped elements.

The present invention is a method for constructing a continuous concrete slab panel, the method comprising the steps of placing a plurality of post on a subgrade surface; connecting the post with a plurality of mounting frames, wherein the mounting frames are assembled in a honeycomb pattern and being spaced apart from each other to form a plurality of joint lines; pouring concrete onto the subgrade surface to the top edge of the mounting frames; and wherein the mounting frame acts as joint lines for crack inducer and joint filler for the concrete slab to relieve the build-up of tensile stresses within the slab.

The hexagonal shaped concrete slab reduces the curl and stresses of the concrete slab panels significantly because the material (ready-mix concrete) is spread out and cures evenly unlike the common square shaped saw-cut concrete panels. Square shaped concrete panel curls at the corners and causes high levels of stresses inside the volume of the concrete slab. The main advantage of reducing stress level as well as curling in the slab panels is to reduce reinforcement means and load transfer device at the joints.

It is an object of the present invention to provide a device and a method to reduce curl and stresses in the concrete slab panels.

It is another object of the present invention to provide a device and a method to reduce the amount of reinforcement means required in the concrete slab panels.

It is another object of the present invention to provide a device and a method to eliminate the need for load transfer devices at contraction joints as well as construction joints.

It is another object of the present invention to provide a device and a method to eliminate the need to saw-cut for the concrete slab panels in contraction joints.

It is another object of the present invention to provide a device and a method to eliminate the need for joint filler.

It is another object of the present invention to provide a device and a method to eliminate the need to use steel bar in order to reinforce the concrete slab panels.

It is another object of the present invention to provide a device and a method to allow a user to use regular concrete mixes and not expensive special mix designs.

It is another object of the present invention to provide a device and a method to reduce differential in deflection between two adjacent concrete slab panels.

It is another object of the present invention to provide a device and a method to protect the edges of the concrete panels from spalling.

It is another object of the present invention to provide a device and a method to manufacture high performing concrete slabs with low cost compare to the traditional concrete slab panels.

Other objects, features, and advantages of the present invention will be readily appreciated from the following description. The description makes reference to the accompanying drawings, which are provided for illustration of the preferred embodiment. However, such embodiments do not represent the full scope of the present invention.

BRIEF DESCRIPTION OF THE DRAWINGS

Embodiments herein will hereinafter be described in conjunction with the appended drawings provided to illustrate and not to limit the scope of the claims, wherein like designations denote like elements, and in which:

DETAILED DESCRIPTION OF PREFERRED EMBODIMENTS

The present invention is a device and a method for constructing a continuous concrete slab. The method comprises of the following steps: (a) placing a plurality of posts on a subgrade surface; (b) connecting the post with a plurality of mounting frames to form a honeycomb pattern; (c) pouring concrete onto the subgrade surface up-to the top edges of the mounting frames, wherein the mounting frame provides a spacing between the concreted in the adjacent hexagonal shapes of the honey comb, and whereby the mounting frame acts as the saw cut, a joint filler and shrinkage control joint for the concrete slab and to relieve the build-up of tensile stresses within the slab.

Figure 1:
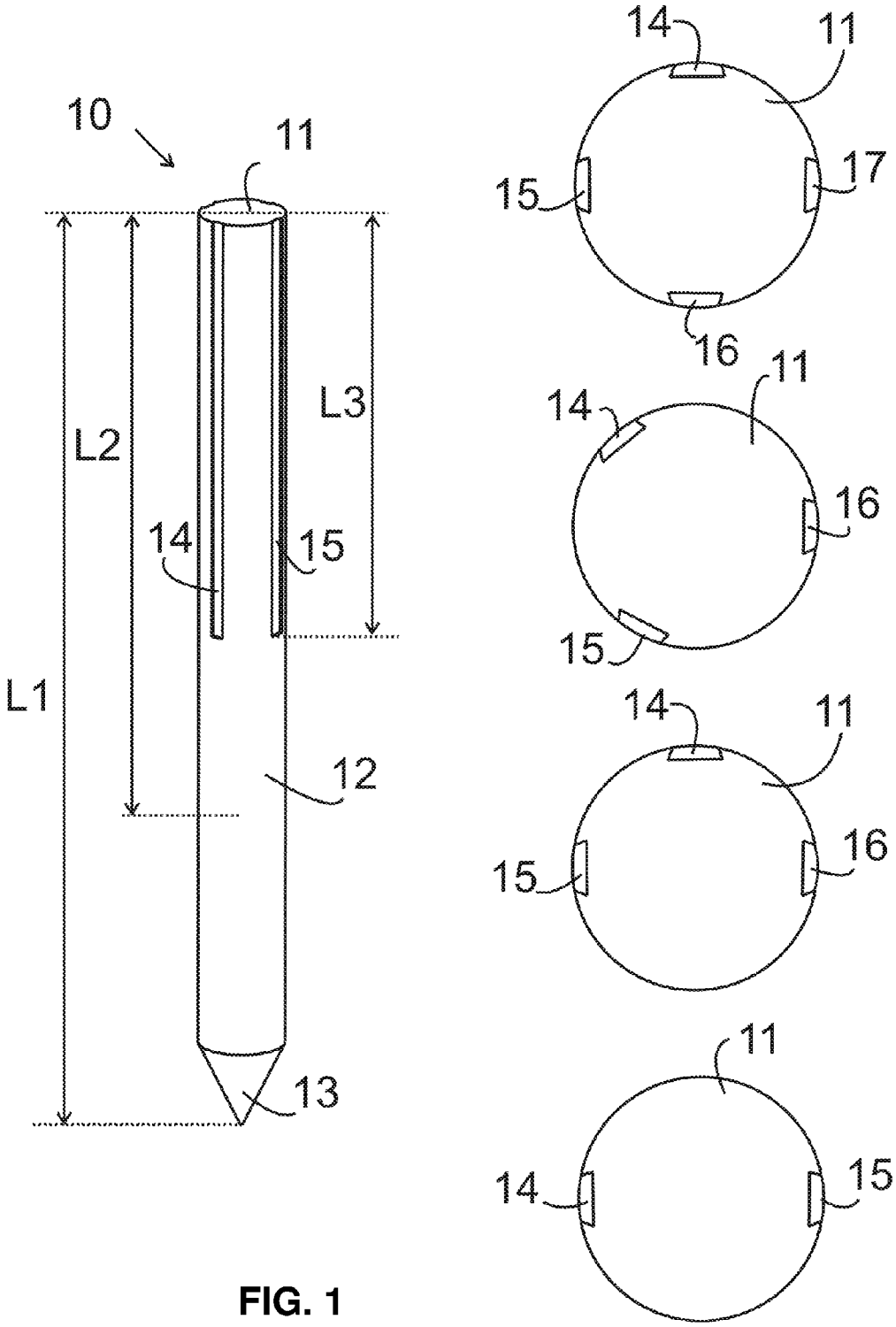
FIG. 1 shows one embodiment of a post of the present invention which having a sharp end to be placed in a subgrade.

FIG. 1 shows one embodiment of a post, 10, of the present invention which has a sharp end 13 to be placed in a subgrade. Each, post, 10, is used to hold a plurality of mounting frames of the present invention.

Figure 2:
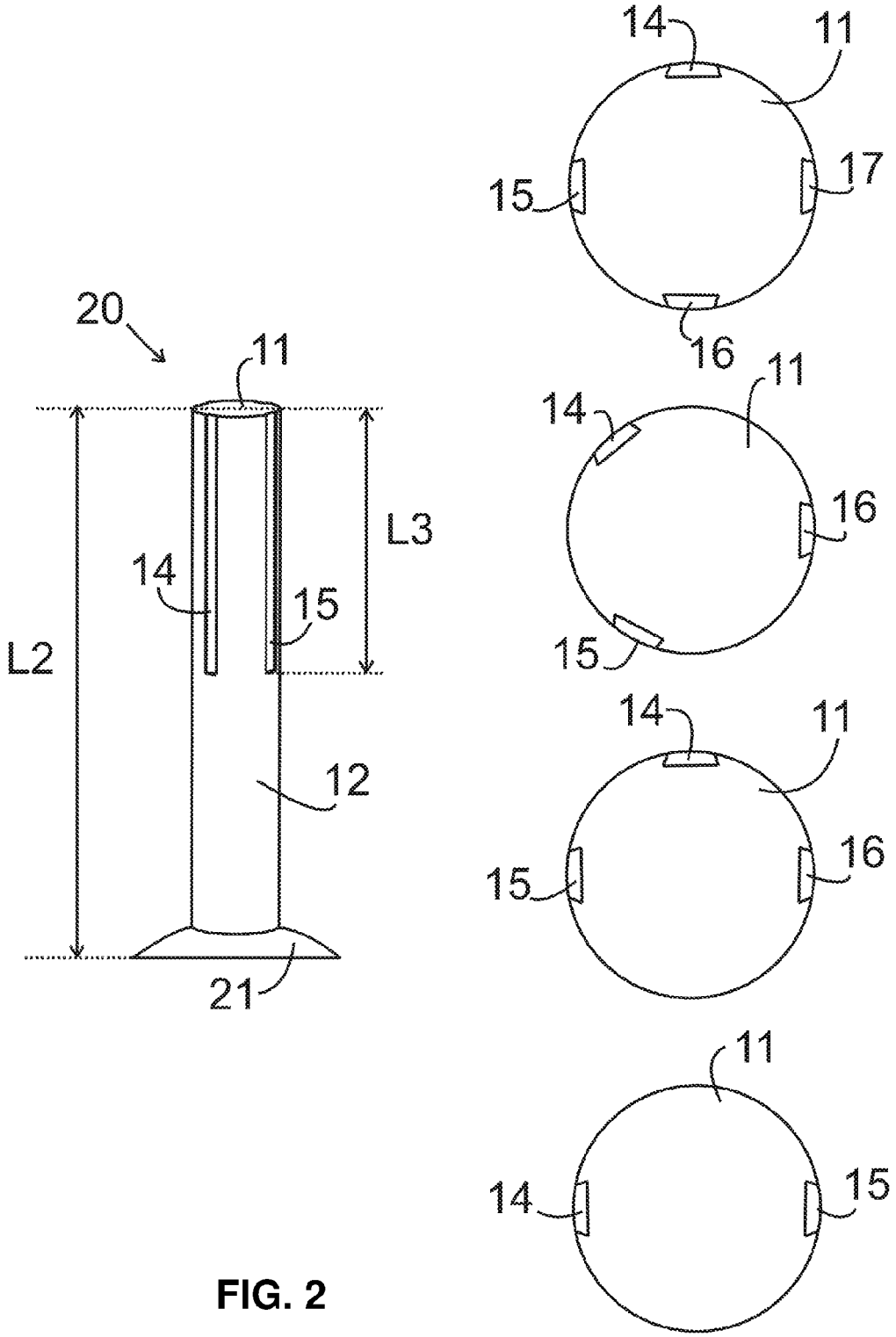
FIG. 2 shows one embodiment of a post of the present invention which having a base to be placed on a subgrade.

FIG. 2 shows another embodiment of a post 20 of the present invention which has a base 21 to be placed on a subgrade.

Figure 6:
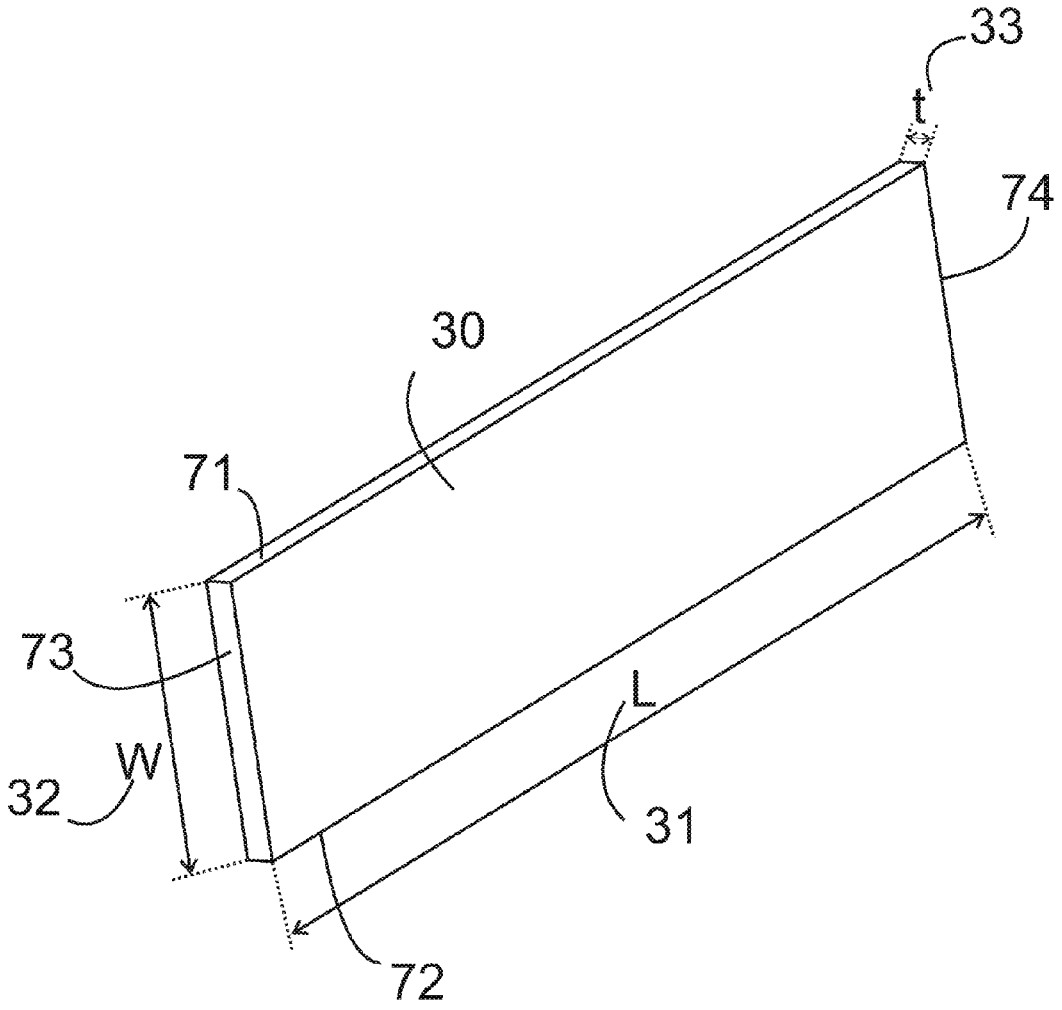
FIG. 6 shows a mounting frame of the present invention.

As shown in FIGS. 1-2 and 6, the post 10, 20 has a body 12, a top end 11 and a plurality of grooves 14-17, which hold a plurality of mounting frame 30. The top end 11 defines the height of the concrete slab. The post can have a levelling means to level the position of the post in the subgrade surface area. The post can have a bubble level (not shown) designed in the top portion of the post.

Again as shown in FIGS. 1-2 and 6, the grooves 14-17 designed in a manner to grab a distal end 31 of the mounting frame 30 in a way that during the concrete pouring, the location of the mounting frame is fixed in the body 12 of the posts 10, 20. There are different methods available for affixing the mounting frame 30 in the grooves 14-17 of the post 10, 20. A preferred method is to have a sliding mounting frame, which is introduced inside the grooves 14-17 from the top end 11 of the post 10, 20.

Figure 3:
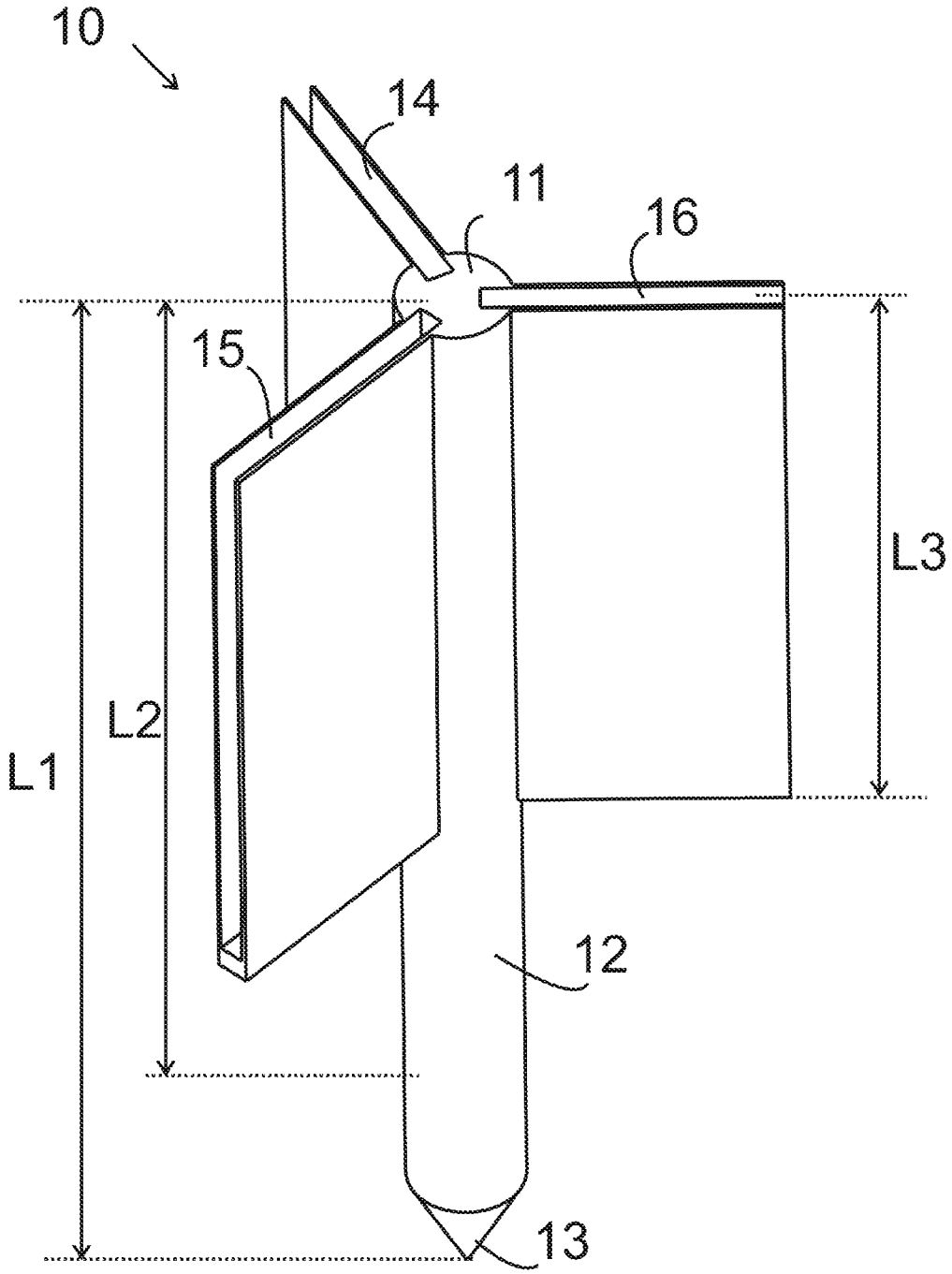
FIG. 3 shows one embodiment of a post of the present invention which having a sharp end to be placed in a subgrade.
Figure 4:
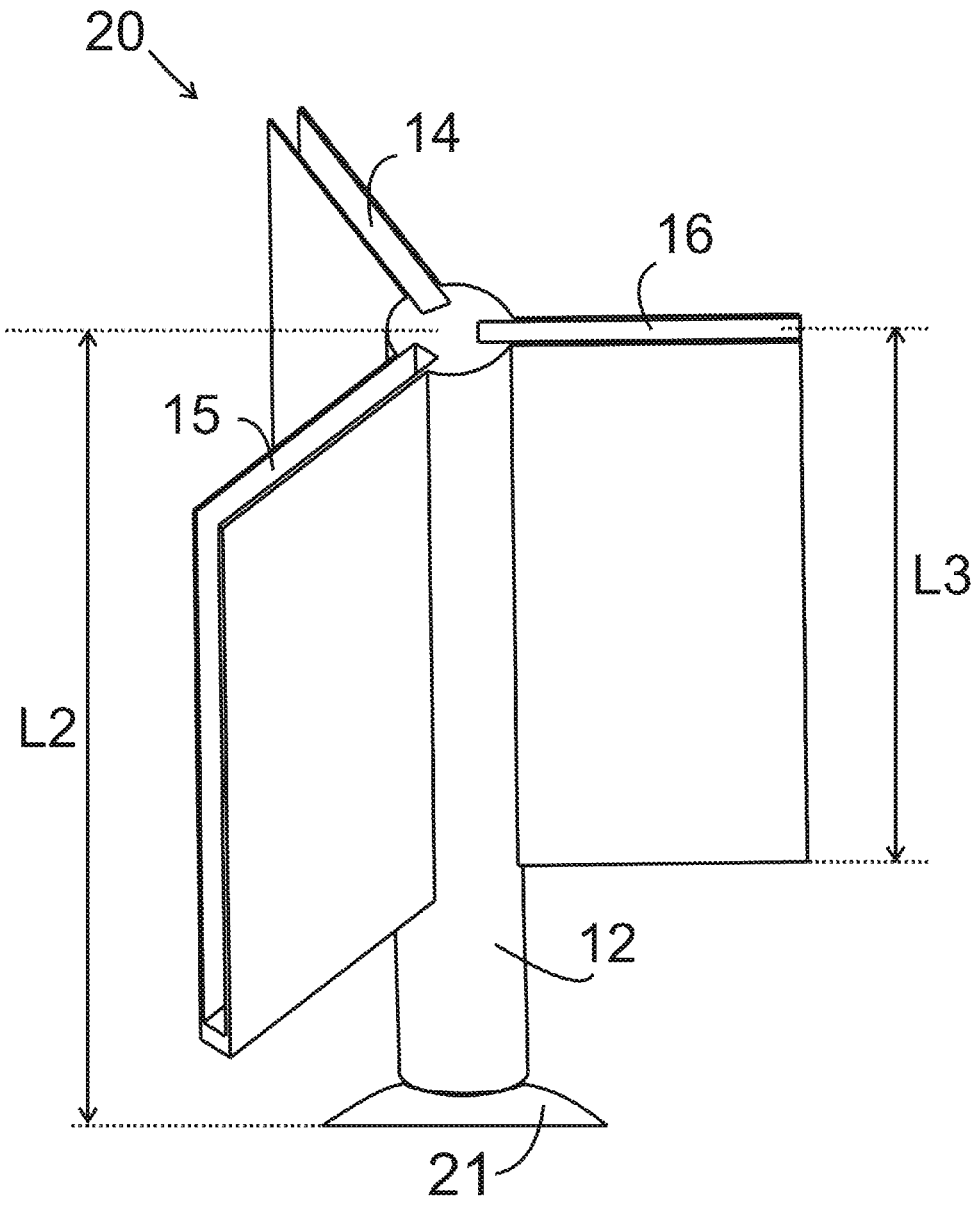
FIG. 4 shows one embodiment of a post of the present invention which having a base to be placed in a subgrade.
Figure 5:
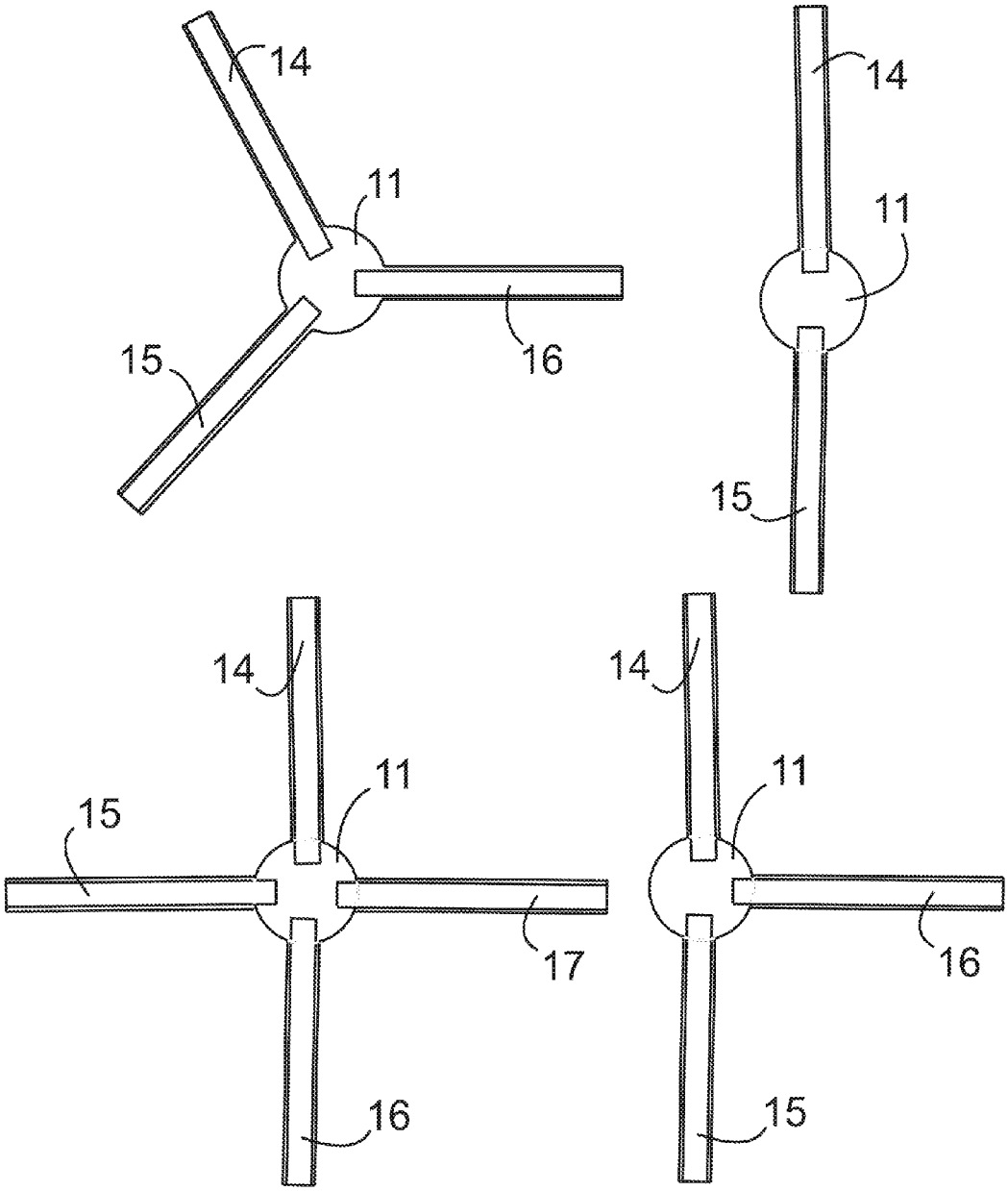
FIG. 5 shows different embodiment of a top end of a post of the present invention.

The post 10, 20 in the present invention can have different profile shapes as shown in FIGS. 3-5. The only purpose of the post 10, 20 of the present invention is to grab and hold the mounting frames 30 in a proper location. The length of the grooves 14-17 on the body 12 of the post 10, 20 can be adjustable depending on the width of the mounting frame.

As shown in FIGS. 1-4, L1 is the total length of the post, L2 is the length of the post which is exposing to the concrete and also is equal to the thickness of the concrete slab panel and L3 is the width of the mounting frame. As shown in FIG. 5, the post 10 and 20 has varieties for connection to the mounting frame. A "Y" connector which connects a post 10, 20 to three mounting frames and also provides 120 degrees angle for each adjacent mounting frame is shown. A "T" connector also showed which connects a post 10 or 20 to two mounting frames. and a "+" (cross) connector is also shown which connects one post 10, 20 to four mounting frames. The mounting frame is slide into the grooves 14-17 and secure inside the grooves 14-17. The angled grooves 14-17 are designed to facilitate the installation of the post and the mounting frame in the subgrade surface.

The material of the post 10, 20 can be selected from the group consisting of a plastic, a metal, a fiberglass, a compressible foam, a rubber, a polymer, a wood and combination of any of the mentioned materials.

As shown in FIG. 6, the mounting frame 30 of the present invention has a length 31 (L), a width 32 (W) and a thickness 33 (t). All the dimensional parameters of the mounting plate 30 is adjustable and are varied based on the configuration of the concrete slab. The width 32 (W) of the mounting frame 30 defines the depth of the saw-cut lines and also acts as a joint sealer in the concrete slab.

Saw-cut joints should be spaced according to guidelines from the cement association, and should have a depth of at least one-quarter of the slab thickness. The mounting frame 30 of the present invention can be sized and designed to fulfil the cement association standard for specific concrete slab panels with specific thickness, strength and shapes. By having a mounting frame 30 between two adjacent concrete slabs, the propagation of cracks in the slab is controlled. The weakened planes where the concrete can crack in a straight line forms underneath the finished concrete surface.

Figure 7:
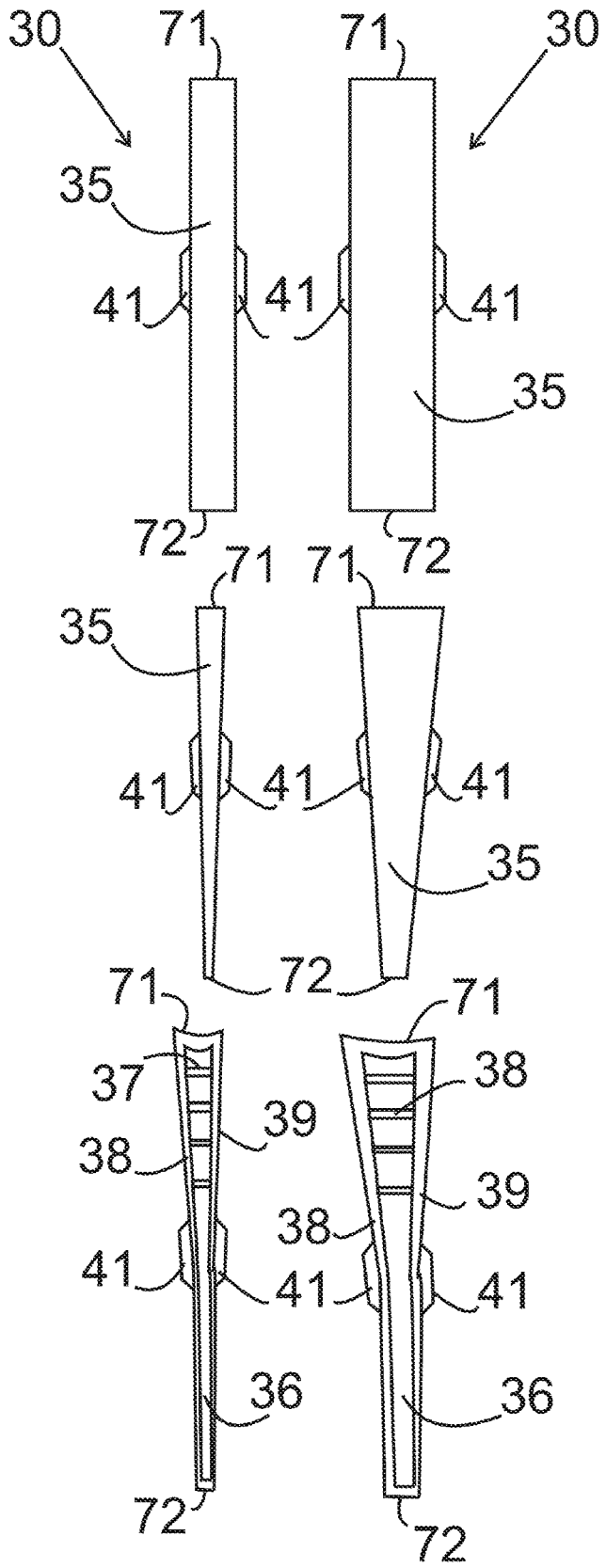
FIG. 7 shows a cross section of different embodiment for the mounting frame of the present invention.
Figure 8A:
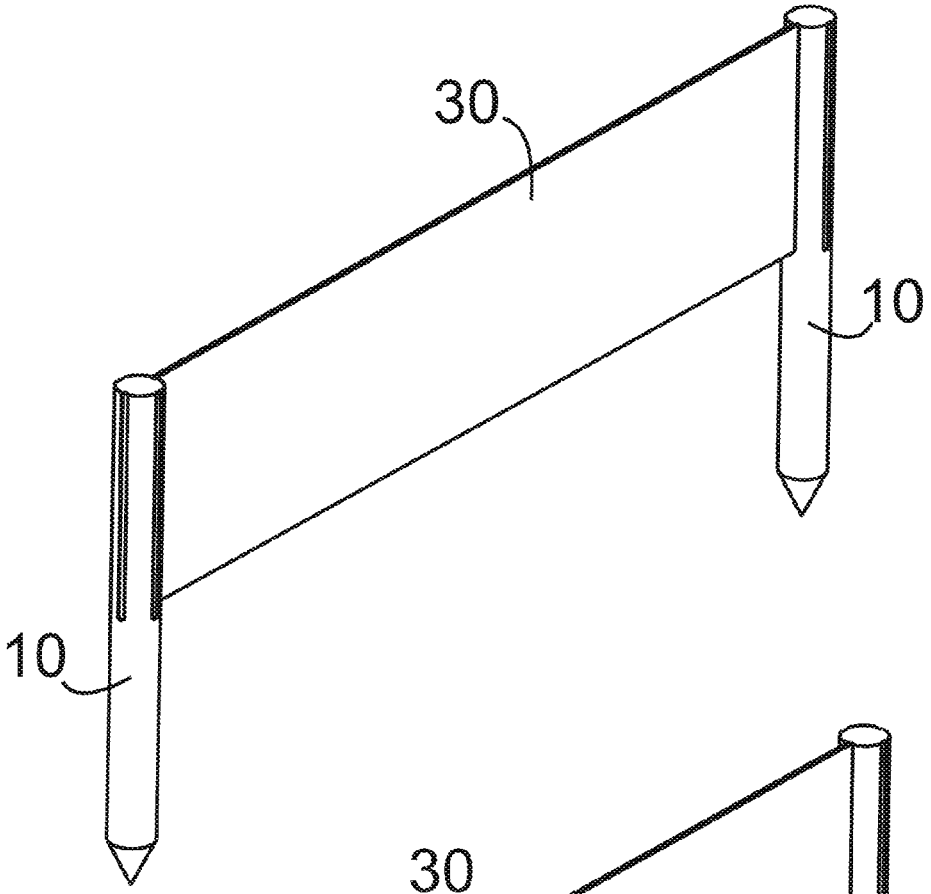
FIG. 8A shows two posts of the present invention are connected with a mounting frame.
Figure 8B:
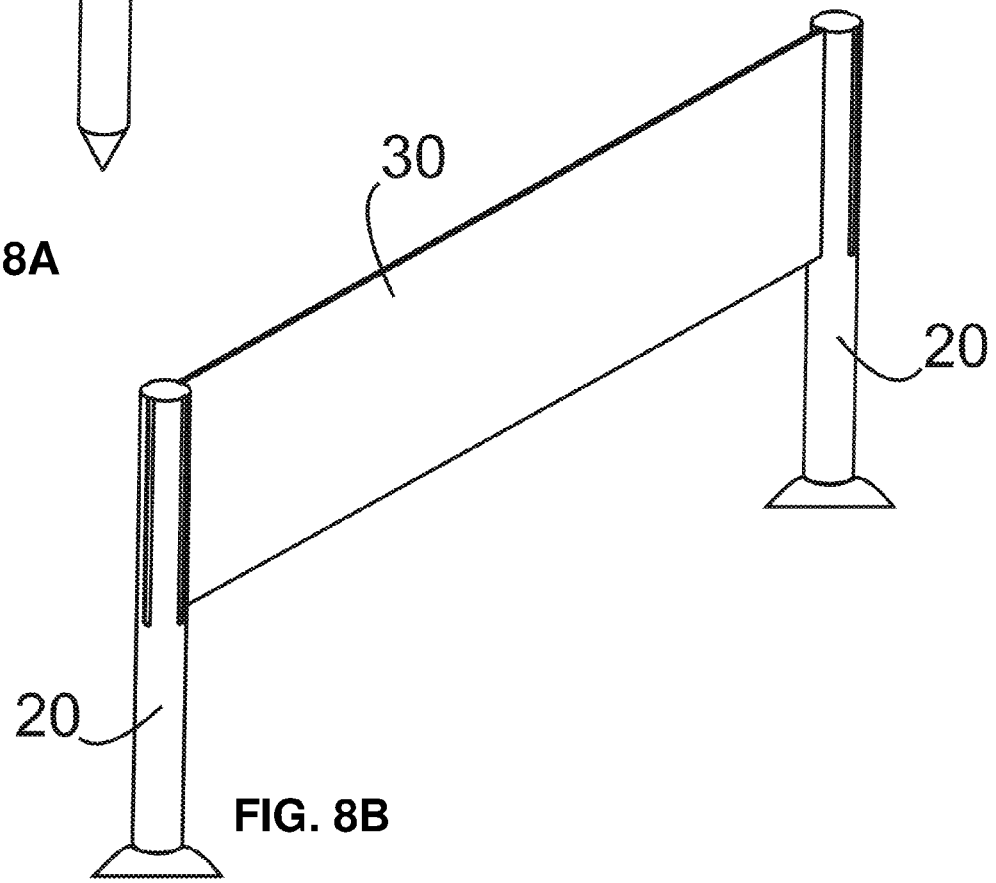
FIG. 8B shows two posts of the present invention are connected with a mounting frame.

The thickness 33 (t) of the mounting frame 30 depends on the thickness of the joint sealer for the concrete slab. FIG. 7 shows different cross section 35 of the mounting frames 30 of the present invention. The thickness 33 (t) can be defined by the standards and regulations which exist for the concrete slab panel manufacturers. The thickness 33 acts as a filler between the two adjacent slab panels to fill the gap formed after concrete shrinkage. FIG. 7 shows the cross sectional views 35 of different embodiments of the mounting frame 30. The mounting may be of a type that deforms during the pouring of the concrete and it expands during curing and shrinkage of the concrete, providing a seal. The material and the design of the cross section 35 of the mounting frame 30 can be selected from the resilient material which compresses in a specific stress and expands after the stress is reduced.

Again as shown in FIGS. 6-7, the mounting frame 30 has a top 71 and a bottom 72. The top 71 of the mounting frame 30 is aligned with the top of the poured concrete and the bottom 72 of the mounting frame 30 act as a crack inducer for the concrete slab panel. The concrete slab panel will crack at the bottom 72 of the mounting frame 30 to the bottom of the poured concrete slab panel.

Different cross sections 35 of the mounting frame 30 are shown in FIG. 7 before and after the pouring and curing process during a concrete slab panel production. As shown in FIG. 7, the cross section 36 can be a hollow cross section 36 which has means 37 to push two walls 38-39 inside the mounting frame 30 outwardly to fill the gap between two adjacent slab panels after the curing process.

The material of the mounting frame 30 is being selected from the groups consisting of a plastic, a polymer, an elastomer, a rubber, a fiberglass, a compressible foam, a metal and a wood. The characteristic of the above materials make the mounting frame 30 of the present invention a perfect candidate for acting as a joint sealer and also forming the weakened planes in the concrete slab. During the concrete pouring, the thickness (t) of the mounting frame 30 is reduced by the pressure from the mix concrete and then increases once the concrete slab is cured and dried. The elastomeric character of the mounting frame 30 fills the gap between the two adjacent concrete slabs.

Again as shown in FIG. 7, the mounting frame 30 further has a build-in load transfer device 41, which is attached to the outside walls of the mounting frame 30 to transfer the load between two adjacent concrete slab panels. The configurations and the shapes of the build-in load transfer device can vary based on the characteristic of the concrete slab panels.

Figure 9A:
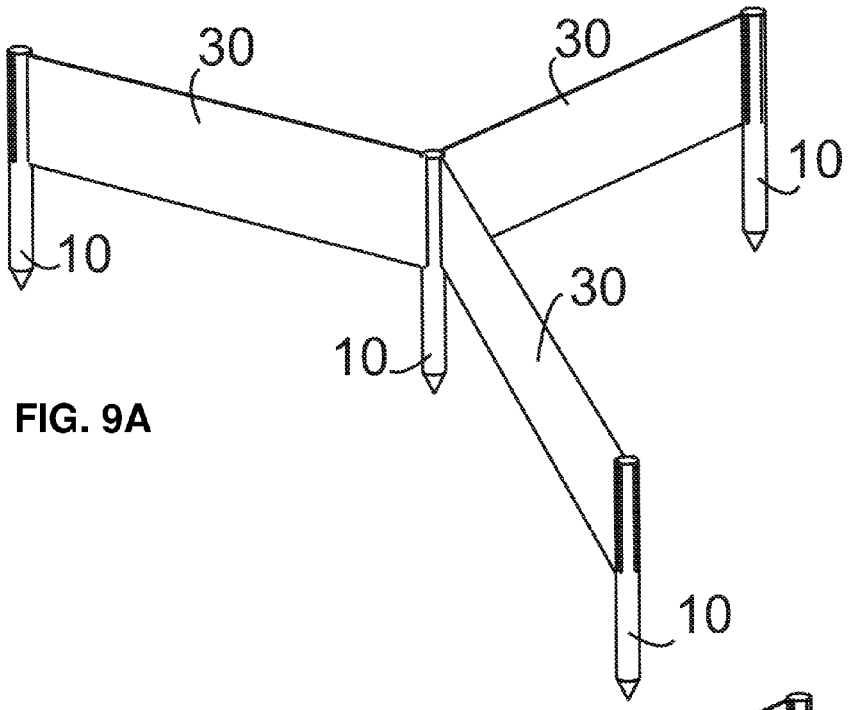
FIG. 9A shows four posts of the present invention are connected with three mounting frames.
Figure 9B:
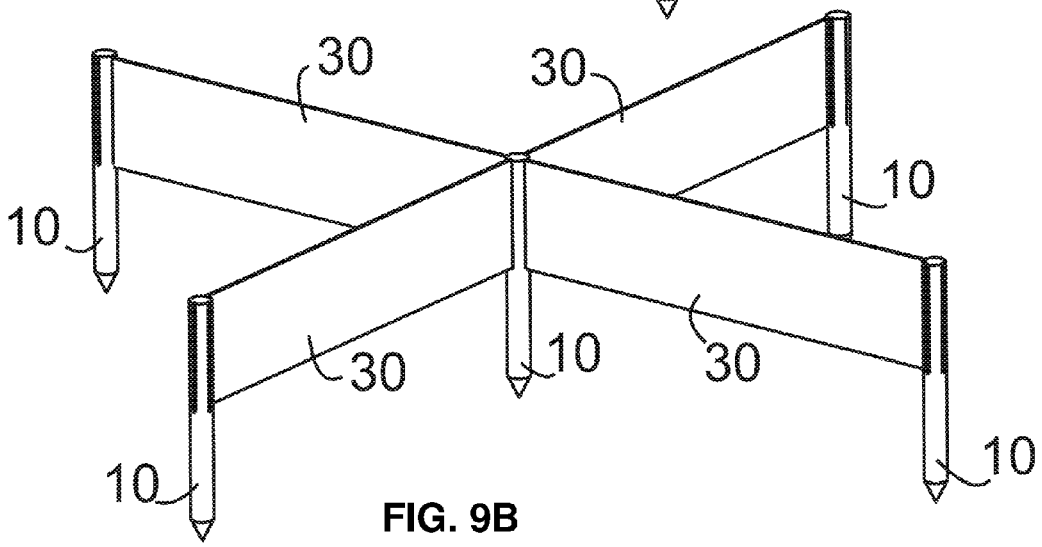
FIG. 9B shows five posts of the present invention are connected with four mounting frames.

FIGS. 8A, 8B, 9A and 9B show a variety of ways which posts 10, 20 and the mounting frames 30 of the present invention may connect to each other. The number of posts and mounting frames, as well as the type of the connecting means on the post depends on the total area to be covered by the concrete slab. FIG. 9A shows four posts 10 connecting three mounting frames 30 to make the required ribs for a honeycomb arrangement. FIG. 9B shows five posts 10 connecting four mounting frame 30 to make the required ribs for a tetragonal arrangement. The length of the mounting frames 30 can be adjustable based on the total area where concrete is poured.

Figure 10A:
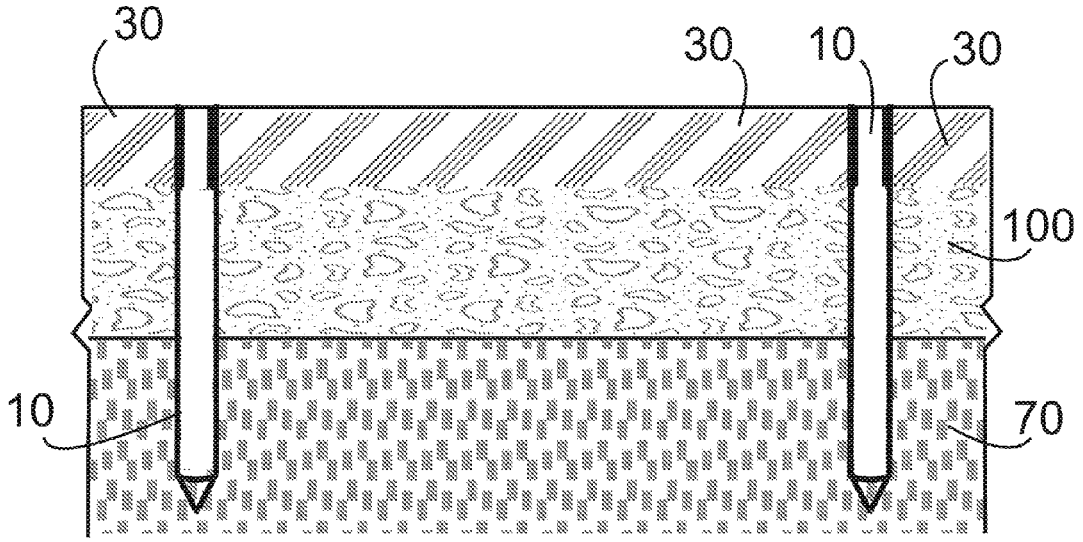
FIG. 10A shows two posts of the present invention with the mounting frame inside of a concrete slab.
Figure 10B:
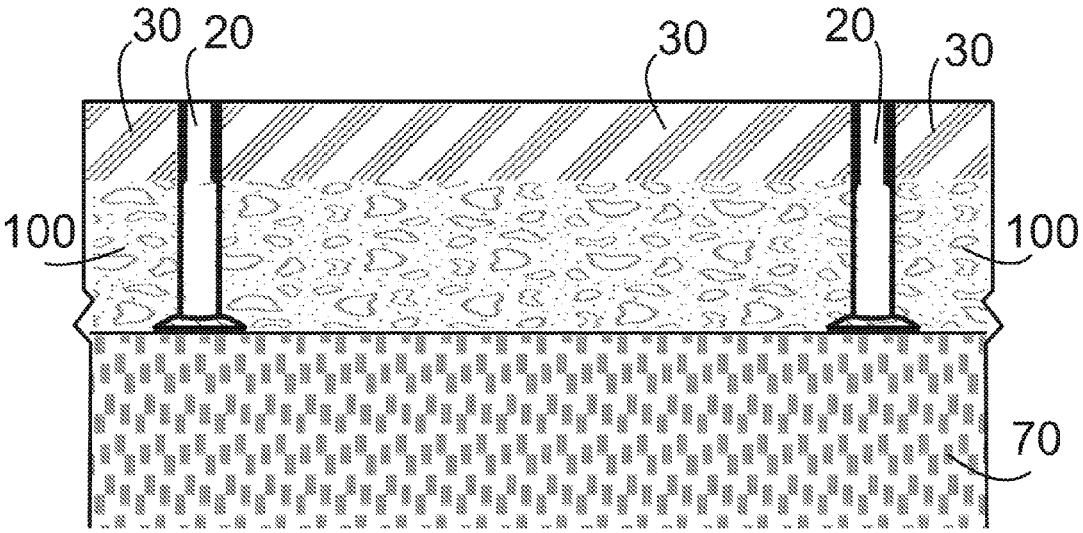
FIG. 10B shows two posts of the present invention with the mounting frame inside of a concrete slab.

FIGS. 10A and 10B show the posts, 10, 20, and the mounting frames 30 of the present invention in a poured in concrete slab. As shown in FIGS. 10A and 10B, the method for constructing a continuous concrete slab panel comprises of the following steps: (a) placing a plurality of posts 10, 20 on a subgrade surface 70; (b) installing a plurality of mounting frames 30 in between every two posts to form a honey comb structure, wherein the frames form a plurality of saw-cut lines; (c) pouring concrete 100 onto the subgrade surface 70 up to the top edges of the mounting frames; (d) allowing the concrete to cure and shrink, wherein the mounting frames 30 act as a crack inducer and joint sealer for the concrete slab 100 to relieve the build-up of tensile stresses within the slab 100.

As shown in FIG. 10B, the post 20 can be placed on the subgrade surface 70. Any combination of a post 10 with the sharp end and a post 20 with a base can be used.

Frames do not touch the ground and the poured in concrete from one side of the frame attached the concrete on the other side of the frame forming a continuous joint less concrete slab. The mounting frame 30 acts as a crack inducer and joint sealer for the concrete slab 100.

In one embodiment of the present invention, a securing means is used to secure the location of the post 10, 20 and the mounting frames 30 during the pouring process of concrete. The securing means holds the post and the mounting frame in a proper location during the pouring and curing processes.

Figure 11:
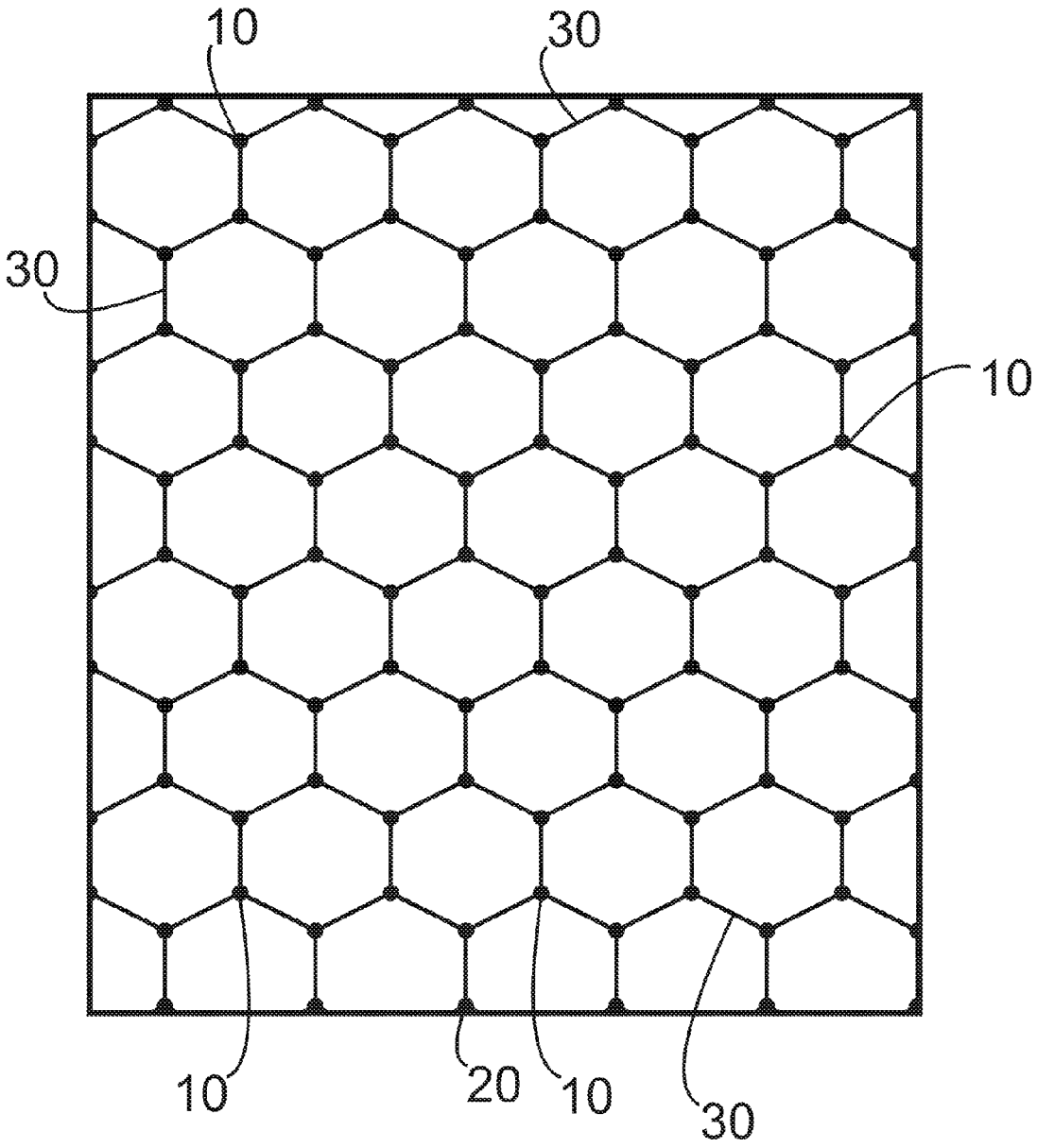
FIG. 11 shows the present invention in a honeycomb pattern.

FIG. 11 shows a honeycomb pattern of the post and frame assembly of the present system. The location for installation of the posts 10, 20 can vary based on the shape and the boundaries of the area to be covered by concrete. It is shown that honeycomb pattern results in a low tensile stress inside the concrete during the curing process, and consequently a very low level of curling on the edges of the concrete slab. Therefore, the hexagonal shape of the concrete slab panel helps to reduce the curling and shrinkage during the curing of the concrete.

Figure 12:
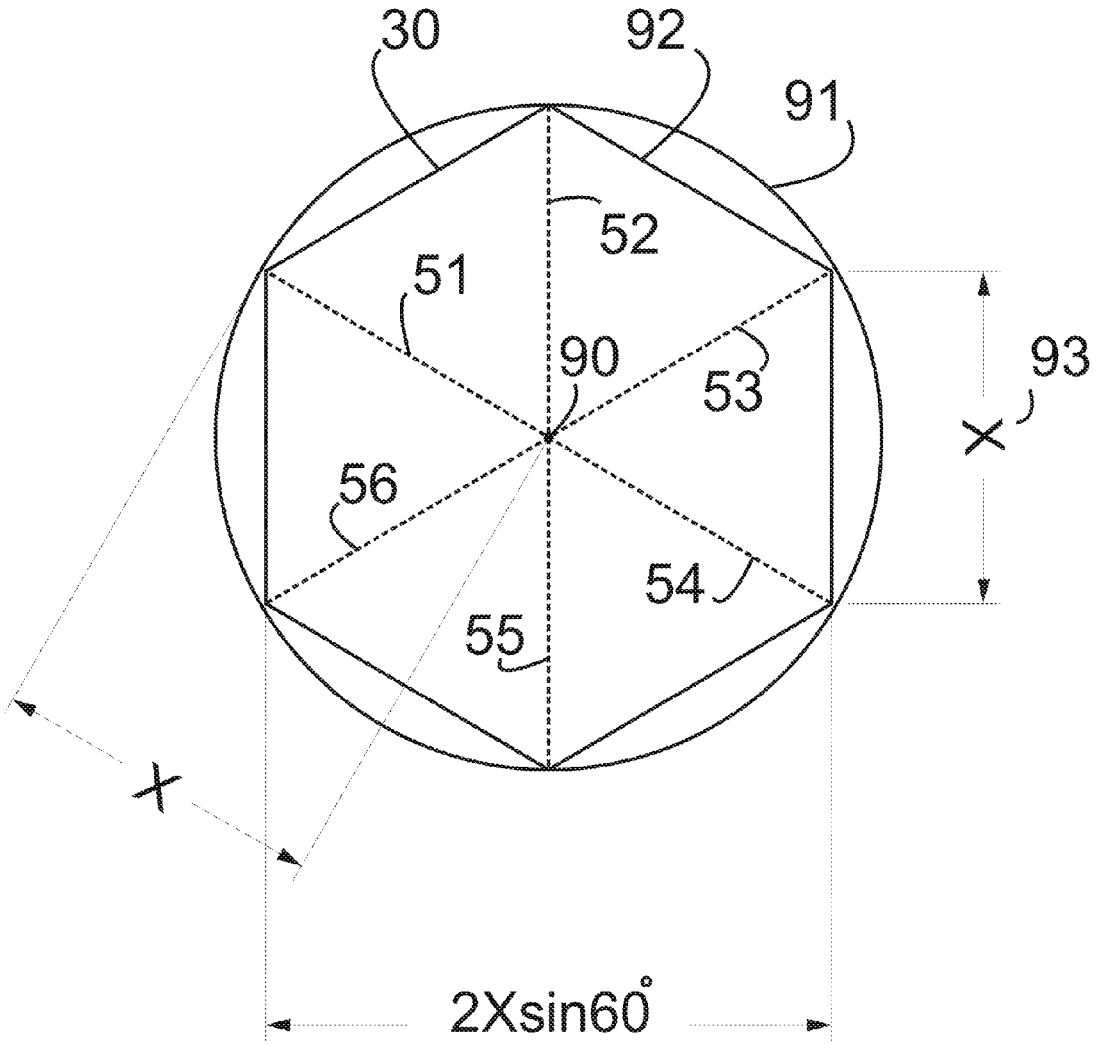
FIG. 12 shows a hexagonal shaped concrete slab panel of the present invention.

Traditionally, a saw cut is provided on a concrete slab panel, as soon as a joint can be cut, to create a weakened plane, preferably without creating spalling at the joint. This is done so that the floor slab cracks at the saw cut instead of randomly breaking at different locations, creating an undesirable look. In the present invention the mounting frames act as a saw cut and also act as a filler to fill the gap between two adjacent slab panels. As shown in the FIG. 12, a uniform shrinkage of a slab panel can be achieved only for a circle panel 91. In a circular panel, the distance from the periphery of the panel 91 to the centre of the panel 90 is the same (radius of the circle 93). Therefore, during the shrinkage, the whole structure shrinks evenly. A panel shape, which provides relatively even distances from its periphery to its centre, yet it is easy to construct and put together is a hexagonal shaped 92. As shown in FIG. 12, the hexagonal shaped slab panel 92 has six equal sides 51-56 which shrink equally when the slab panel 92 losses moisture during curing.

The length of the side mounting panels 30 depends on the thickness of the slab panel. Industry guidelines (American Concrete Institute) suggests to calculate the joint spacing (saw cuts) in a regular (low shrinkage mix) slab by Thickness of slab panel (inch)×2.5=Joint Spacing (feet)

So the distance between the saw cuts in the present invention as shown in FIG. 12 is 2x sin(60°) which x is the length of each side of the hexagonal 92 which fits inside a circle 90 with a radius of x.

For example, if the thickness of the slab panel is six inches, then the standard joint spacing would be 15 feet. Therefore when constructing a hexagon concrete panel, each mounting frame would be approximately 8.6 feet long in order to achieve 15×15 feet concrete hexagon shaped cells.

$$\text{Thickness of slab panel (inch)}\times 2.5 = 2x\sin(60°)$$

$$x \cong 8.6$$

If the thickness of the slab panel is 8 inches, then the standard joint spacing would be 20 feet in a regular slab, so the side mounting frames in this case would be approximately 11.5 feet long.

$$\text{Thickness of slab panel (inch)}\times 2.5 = 2x\sin(60°)$$

$$x \cong 11.5$$

In another embodiment of the present invention, the mounting panels 30 in units of feet is between the ranges of 1 to 2 times of the thickness of the continuous concrete slab in units of inches. For example, if the thickness of the slab panel is six inches, then the joint spacing would be 6 to 12 feet.

In general, the polygon side length is determined based on the thickness of the concrete slab. In one embodiment, the following relationship is used to determine the polygon side length:

polygon-side-length (feet)=1.25×said thickness of concrete slab (inches)/sin(polygon half angle), wherein polygon half angle is the half of the angle between two adjacent polygon sides.

The present invention allows making multiple sided individual concrete panels; this is something that cannot be done by today's methods as saw cutting gives four sided panels.

With the present invention, the concrete panels are formed individually during the concrete placement, before the concrete sets. This is the only way one can have a honeycombed pattern slab and hexagon patterned individual panels. The frame reduces the shrinkage stress from the slab as a whole (separating the slab into smaller panels just like saw cutting), and also reduces the tensile and curling stresses in each individual panel because of the hexagon shape. The frame also holds all those panels together to make it one big slab.

Since the system reduces the stress of the whole slab as well as individual concrete panels, one can reduce the thickness of concrete that is normally needed to accommodate a given load.

Figure 13:
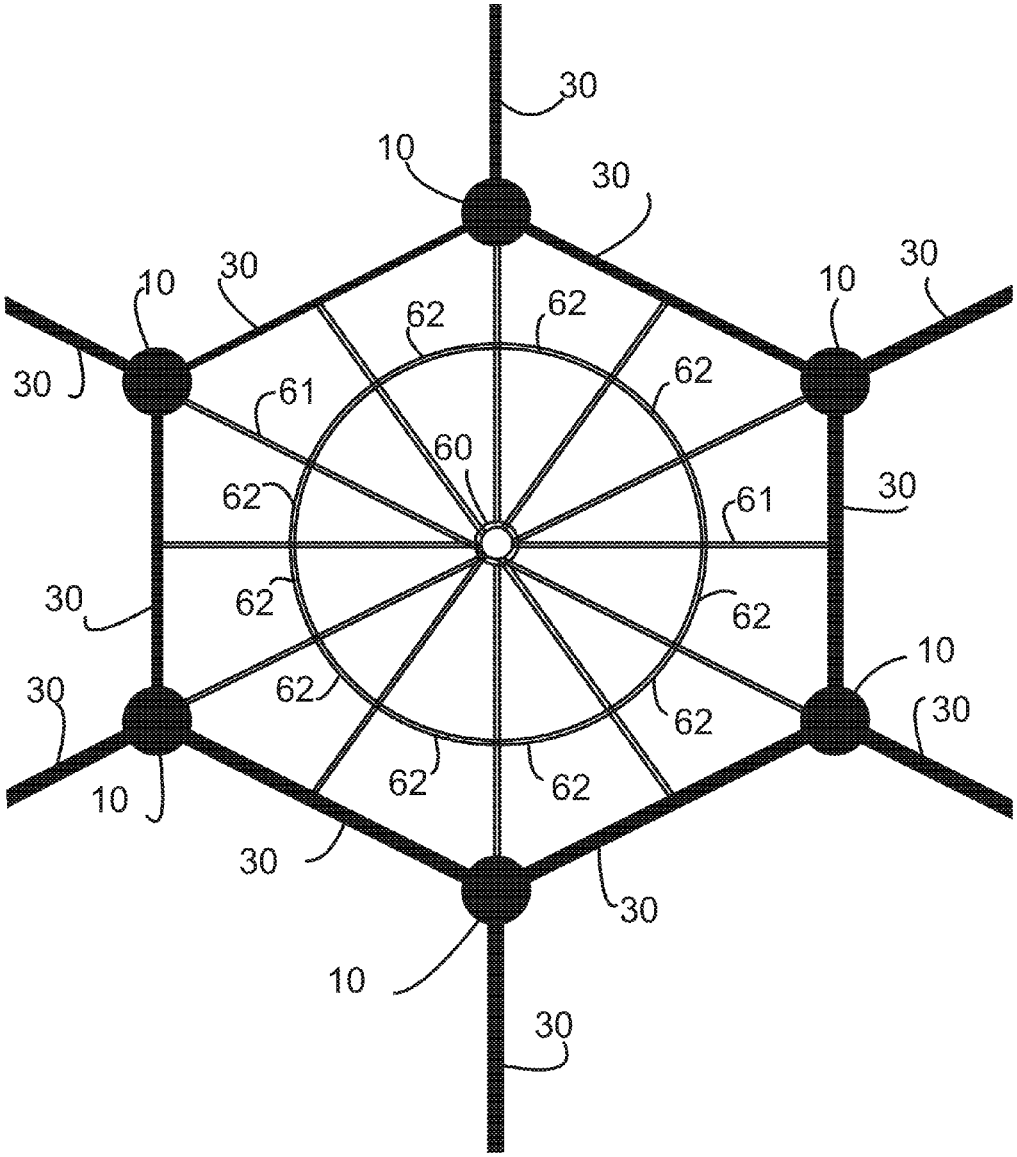
FIG. 13 shows a hexagonal shaped concrete slab panel of the present invention.

As shown in FIG. 13, in another embodiment of the present invention, the mounting frame 30 can be further secured by attaching a reinforcement rod 61 placed between two neighbouring mounting frames 30 or a post 10 and a connector 60 placed at the centre of the hexagonal shaped element. The reinforcement rods 61 can also be secured to each other by reinforcement connectors 62 when needed. The whole structure for reinforcement looks like a spider web which secures all the mounting frames 30 and the posts 10 in a proper position. The specific design for the reinforcement rods also reduces the risk of curling and tensile stress pile-up inside the concrete volume. This acts as mid-panel reinforcement for the concrete slab panel, so instead of rebar, which cannot move in a conventional method for concrete pouring, the web designed can moves with the concrete when it shrinks. The reinforcement rods move to the middle, so there is no cracking as the concrete shrinks to the middle. If the concrete cracks the rods still support the whole structure.

Figure 14:
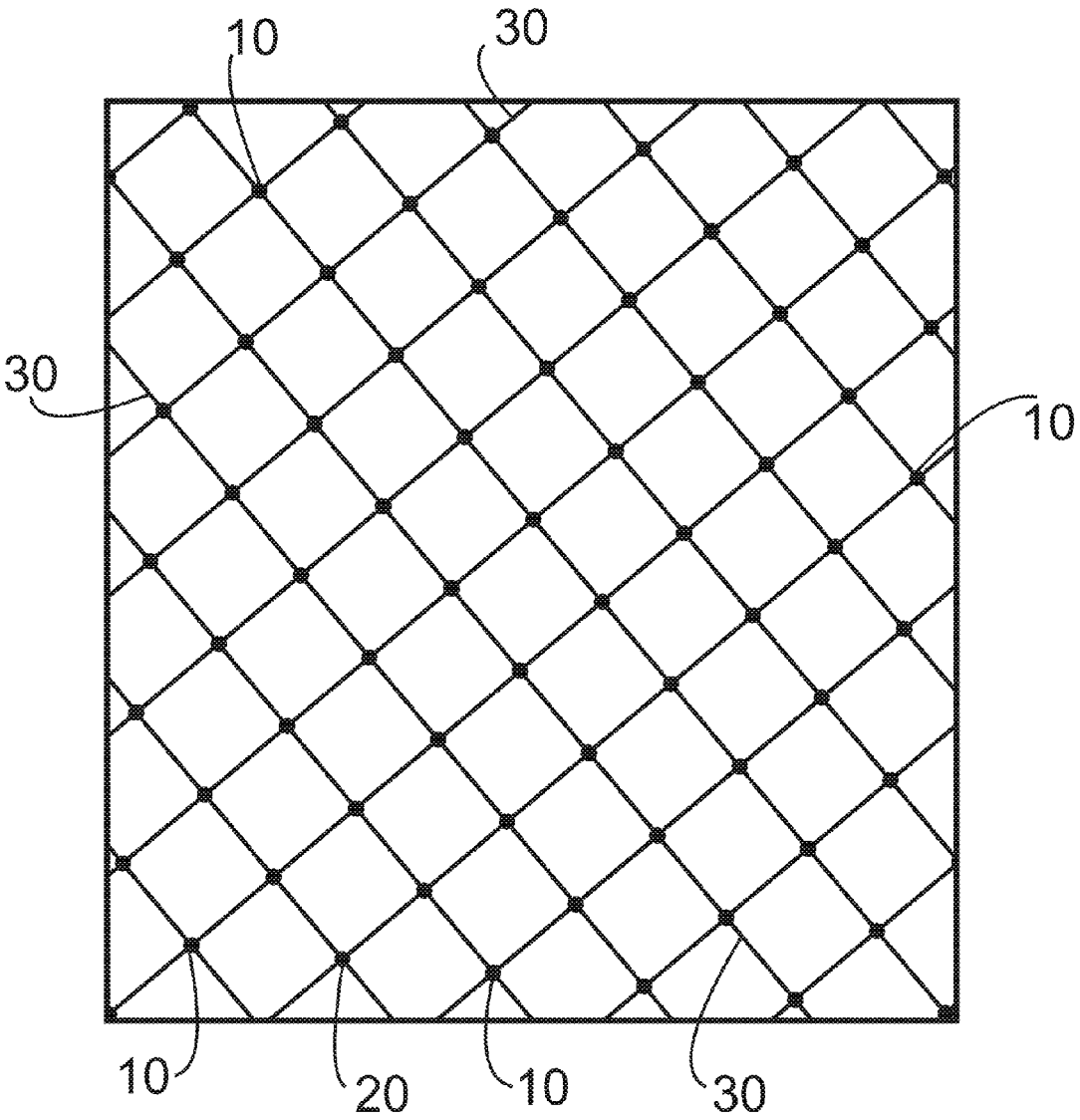
FIG. 14 shows the present invention in a rectangular pattern.
Figure 15:
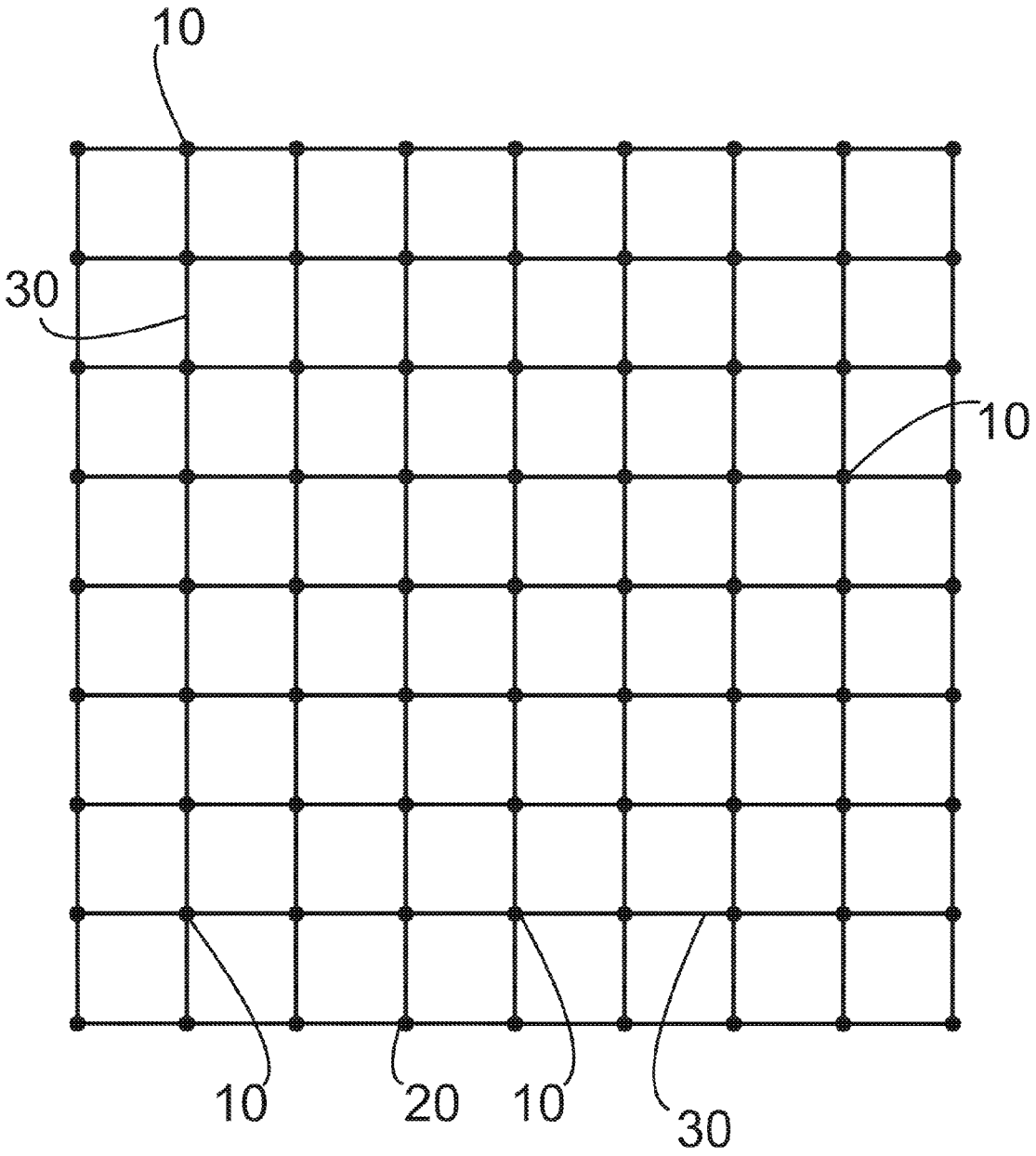
FIG. 15 shows the present invention in a square pattern.

FIGS. 14 and 15 show the present invention having a rectangular pattern. The method used in the present invention to divide the area into similar patterns as a honeycomb pattern or a rectangular pattern make it unique in terms of cost and time. Installation of the post 10, 20 and the mounting frame 30 reduce the cost and time for saw-cut procedure for concrete forming.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

With respect to the above description, it is to be realized that the optimum relationships for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by the present invention.

What is claimed is:

1. A method of constructing, reinforcing, joint sealing and edge protecting of a continuous concrete slab over a surface area, wherein the continuous concrete slab having a thickness, the method comprising the steps of:

a. determining a joint-spacing-length for said continuous concrete slab based on a predetermined factor of said thickness of the concrete slab;

b. choosing a polygonal-concrete-shape to prevent concrete curling after curing process;

c. determining a polygon-side-length for said polygonal-concrete-shape based on the joint-spacing-length;

d. subdividing said subgrade surface area into a plurality of said polygons using a plurality of mounting frames, wherein said mounting frames are connected and held on said surface area by a plurality of perpendicularly placed mounting posts having means to connect said mounting frames, wherein said means to connect said mounting frames comprises of a plurality of elongated grooves designed in a body of said post to engage with said mounting frames, wherein each said mounting frame having a frame-length, a frame-height, a frame-thickness, a frame-bottom end and a frame-top end, forming a stationary polygonal web, and e. pouring concrete onto said stationary polygonal web until the concrete reaches to said frame-top end, whereby the mounting frames assembly subdivide the continuous concrete slab into a plurality of said polygonal-concrete-shapes by inducing formation of fine cracks along the frame-bottom end of said mounting frame and wherein said mounting frames act as saw-cuts and joint fillers between said concrete-pattern-shapes.

2. The method of claim 1, wherein the joint-spacing length (feet) is equal to 2.5 times the thickness of the continuous concrete slab (inches).

3. The method of claim 1, wherein said polygonal-concrete-shape being selected from the groups consisting of a triangle, a square, a rectangle, a pentagon, a hexagon, a heptagon, an octagon and a decagon.

4. The method of claim 1, wherein said frame-length is substantially equal to the polygon-side-length.

5. The method of claim 1, wherein said mounting frames are reinforced by connecting a plurality of circumferential reinforcement bars to one another to keep said mounting frames in a proper position during the concrete pouring process.

6. The method of claim 1, wherein said concrete-pattern-shape is an equal side hexagon.

7. The method of claim 6, wherein said polygon-side-length in units of feet is between the ranges of 1 to 2 times of the thickness of the continuous concrete slab in units of inches.

8. The method of claim 1, wherein said polygon-side-length is equal to:

$$\text{a polygon-side-length (feet)} = 1.25 \times \text{said thickness of concrete slab (inches)} / \sin(\text{a polygon half angle}),$$

wherein said polygon half angle is the half of the angle between two adjacent polygon sides.

9. The method of claim 1, wherein said frame-length being approximately between 1 foot to 25 feet.

10. The method of claim 1, wherein frame-height is at least one-quarter of the thickness of said continuous concrete slab.

11. The method of claim 1, wherein said mounting frames connects to said elongated groove on said post in a variable height to provide leveling.

* * * * *